US008282781B2

(12) United States Patent
Shakespeare

(10) Patent No.: US 8,282,781 B2
(45) Date of Patent: Oct. 9, 2012

(54) APPARATUS AND METHOD FOR STABILIZATION OF A MOVING SHEET RELATIVE TO A SENSOR

(75) Inventor: John F. Shakespeare, Kuopio (FI)

(73) Assignee: Honeywell International Inc., Morristown, NJ (US)

( * ) Notice: Subject to any disclaimer, the term of this patent is extended or adjusted under 35 U.S.C. 154(b) by 1328 days.

(21) Appl. No.: 11/636,895

(22) Filed: Dec. 11, 2006

(65) Prior Publication Data

US 2008/0136091 A1 Jun. 12, 2008

(51) Int. Cl.
*B65H 23/34* (2006.01)

(52) U.S. Cl. ..... 162/271; 271/227

(58) Field of Classification Search ..... 271/226; 162/271

See application file for complete search history.

(56) References Cited

U.S. PATENT DOCUMENTS

| | | | | |
|---|---|---|---|---|
| 3,103,850 | A | 9/1963 | Khoury et al. | |
| 3,386,635 | A | 6/1968 | Nash | |
| 4,672,841 | A | 6/1987 | Schuster et al. | |
| 4,877,485 | A | 10/1989 | Carson | |
| 4,938,404 | A | 7/1990 | Helms et al. | |
| 5,634,636 | A * | 6/1997 | Jackson et al. | 271/225 |
| 5,793,486 | A | 8/1998 | Gordon et al. | |
| 6,281,679 | B1 | 8/2001 | King et al. | |
| 6,743,338 | B2 | 6/2004 | Graeffe et al. | |
| 6,749,723 | B2 * | 6/2004 | Linden | 162/198 |
| 6,936,137 | B2 | 8/2005 | Moeller et al. | |
| 7,146,279 | B2 | 12/2006 | Typpoe et al. | |

FOREIGN PATENT DOCUMENTS

| | | | |
|---|---|---|---|
| DE | 102004007374 | B3 | 8/2005 |
| EP | 1112951 | A2 | 7/2001 |
| WO | WO 03/035974 | A1 | 5/2003 |
| WO | WO 2004/015197 | A1 | 2/2004 |

* cited by examiner

*Primary Examiner* — Eric Hug
*Assistant Examiner* — Jacob Thomas Minskey

(57) ABSTRACT

A sheet of material is received at a sensor assembly, which includes a sensor operable to measure a property of the sheet. An air flow is generated that is substantially tangential to the sheet in order to at least partially control a position of the sheet relative to the sensor assembly. For example, the sheet may be associated with an upstream boundary layer of air and a downstream boundary layer of air. At least part of the air from the upstream boundary layer could be removed and used to provide an air flow forming at least part of the downstream boundary layer. Also, the air flow could be provided between a surface of the sensor assembly and the sheet to at least partially control a distance of the sheet from the surface of the sensor assembly and/or an angle at which the sheet passes the surface of the sensor assembly.

19 Claims, 2 Drawing Sheets

100

APPARATUS AND METHOD FOR STABILIZATION OF A MOVING SHEET RELATIVE TO A SENSOR

TECHNICAL FIELD

This disclosure relates generally to measurement systems and more specifically to an apparatus and method for stabilization of a moving sheet relative to a sensor.

BACKGROUND

Sheets of material are often used in various industries and in a variety of ways. These materials can include paper, plastic, and other materials manufactured or processed in webs or sheets. As a particular example, long sheets of paper or other materials can be manufactured and collected in reels. These sheets of material are often manufactured or processed at a high rate of speed, such as speeds up to one hundred kilometers per hour or more.

It is often necessary or desirable to measure one or more properties of a sheet of material as the sheet is being manufactured or processed. For example, in a paper sheet-making process, it is often desirable to measure the properties of the sheet (such as its basis weight, moisture, color, or caliper/thickness) to verify whether the sheet is within certain specifications. Adjustments can then be made to the sheet-making process to ensure the sheet properties are within the desired range(s).

Some measurements may require a particular geometry of the measured sheet relative to a sensor. For example, a sensor may be required to take measurements perpendicular to the sheet. Deviations from the expected or required geometry may introduce bias, uncertainty, or other error in the measurements. This problem becomes more pronounced when taking measurements of a moving sheet, which may flutter or otherwise move as it passes by or between sensors.

Several techniques have been developed to take measurements of the properties of moving sheets. In one approach, rollers are placed on both sides of a sensor in the hope that a sheet would remain relatively stable between the rollers. However, this approach may increase the tension on the sheet, which may increase the likelihood of a sheet breaking during the manufacturing or other process. Also, this approach may not work well when the sheet travels at high speeds.

In another approach, a sheet is held against a suction plate that forms part of a sensor carriage or that is located immediately upstream of a sensor carriage. However, this approach requires the sheet to be held in contact with the suction plate while the sheet is moving, which may increase the frictional drag and the tension on the sheet. Also, the suction plate typically has many holes and therefore many edges that contact the sheet, which could (among other things) damage the sheet surface or printing formed on the sheet.

In a third approach, a vortical air flow is generated in a small annulus with a vortex axis perpendicular to a sensor carriage surface. This helps to constrain the position of a sheet relative to the sensor carriage at the center of the annulus. However, the vortical air flow typically does not constrain the sheet position away from the center of the annular flow, which often causes aplanar curvature of the sheet in a region surrounding the center of the vortical flow.

In a fourth approach, a step is formed in a sensor carriage surface, and an air flow is introduced near the step. This forms a captive vortex in the step with a vortex axis parallel to the step. As a result, a sheet position is constrained at a location immediately following the captive vortex. However, this approach typically introduces curvature into the sheet and often allows the sheet position to be controlled only in a small area.

SUMMARY

This disclosure provides an apparatus and method for stabilization of a moving sheet relative to a sensor.

In a first embodiment, a method includes receiving a sheet of material at a sensor assembly. The sensor assembly includes a sensor operable to measure a property of the sheet. The method also includes generating an air flow that is substantially tangential to the sheet in order to at least partially control a position of the sheet relative to the sensor assembly.

In particular embodiments, the sheet is associated with an upstream boundary layer of air and a downstream boundary layer of air. Also, generating the air flow includes removing at least part of the air from the upstream boundary layer and providing the air flow to form at least part of the downstream boundary layer. The generated air flow could include at least part of the air removed from the upstream boundary layer.

In other particular embodiments, generating the air flow includes providing the air flow between a surface of the sensor assembly and the sheet. The air flow at least partially controls at least one of: a distance of the sheet from the surface of the sensor assembly and an angle at which the sheet passes the surface of the sensor assembly.

In yet other particular embodiments, the air flow includes multiple air flows, and at least two of the air flows are directed in different directions to at least partially control a local tension of the sheet.

In a second embodiment, an apparatus includes a sensor operable to measure a property of a sheet of material. The apparatus also includes a sensor carriage operable to carry the sensor. The sensor carriage is also operable to generate an air flow that is substantially tangential to the sheet in order to at least partially control a position of the sheet relative to the sensor carriage.

In a third embodiment, a system includes a sheet machine operable to manufacture and/or process a sheet of material. The system also includes a sensor assembly including a sensor operable to measure a property of the sheet. The sensor assembly is operable to generate an air flow that is substantially tangential to the sheet in order to at least partially control a position of the sheet relative to the sensor assembly.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

Figure 1:
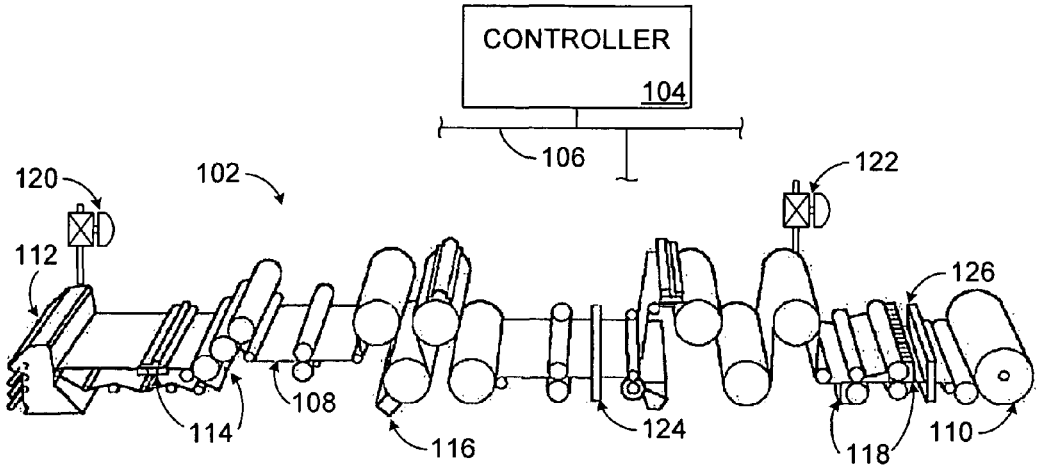
FIG. 1 illustrates an example paper production system according to one embodiment of this disclosure.

FIG. 1 illustrates an example paper production system 100 according to one embodiment of this disclosure. The embodiment of the paper production system 100 shown in FIG. 1 is for illustration only. Other embodiments of the paper production system 100 may be used without departing from the scope of this disclosure.

In this example, the paper production system 100 includes a paper machine 102, a controller 104, and a network 106. The paper machine 102 includes various components used to produce a paper product. In this example, the various components may be used to produce a paper sheet 108 collected at a reel 110. The controller 104 monitors and controls the operation of the paper machine 102, which may help to maintain or increase the quality of the paper sheet 108 produced by the paper machine 102.

As shown in FIG. 1, the paper machine 102 includes a headbox 112, which distributes a pulp suspension uniformly across the machine onto a continuous moving wire screen or mesh. The pulp suspension entering the headbox 112 may contain, for example, 0.2-3% wood fibers, fillers, and/or other materials, with the remainder of the suspension being water. The headbox 112 may include an array of dilution actuators, which distributes dilution water into the pulp suspension across the sheet. The dilution water may be used to help ensure that the resulting paper sheet 108 has a more uniform basis weight across the sheet 108. The headbox 112 may also include an array of slice lip actuators, which controls a slice opening across the machine from which the pulp suspension exits the headbox 112 onto the moving wire screen or mesh. The array of slice lip actuators may also be used to control the basis weight of the paper or the distribution of fiber orientation angles of the paper across the sheet 108.

An array of steam actuators 114 produces hot steam that penetrates the paper sheet 108 and releases the latent heat of the steam into the paper sheet 108, thereby increasing the temperature of the paper sheet 108 in sections across the sheet. The increase in temperature may allow for easier removal of water from the paper sheet 108. An array of rewet shower actuators 116 adds small droplets of water (which may be air atomized) onto the surface of the paper sheet 108. The array of rewet shower actuators 116 may be used to control the moisture profile of the paper sheet 108, reduce or prevent over-drying of the paper sheet 108, or correct any dry streaks in the paper sheet 108.

The paper sheet 108 is then often passed through a calender having several nips of counter-rotating rolls. Arrays of induction heating actuators 118 heat the shell surfaces of various ones of these rolls. As each roll surface locally heats up, the roll diameter is locally expanded and hence increases nip pressure, which in turn locally compresses the paper sheet 108. The arrays of induction heating actuators 118 may therefore be used to control the caliper (thickness) profile of the paper sheet 108. The nips of a calender may also be equipped with other actuator arrays, such as arrays of air showers or steam showers, which may be used to control the gloss profile or smoothness profile of the paper sheet.

Two additional actuators 120-122 are shown in FIG. 1. A thick stock flow actuator 120 controls the consistency of the incoming pulp received at the headbox 112. A steam flow actuator 122 controls the amount of heat transferred to the paper sheet 108 from drying cylinders. The actuators 120-122 could, for example, represent valves controlling the flow of pulp and steam, respectively. These actuators may be used for controlling the dry weight and moisture of the paper sheet 108. Additional components could be used to further process the paper sheet 108, such as a supercalender (for improving the paper sheet's thickness, smoothness, and gloss) or one or more coating stations (each applying a layer of coatant to a surface of the paper to improve the smoothness and printability of the paper sheet). Similarly, additional flow actuators may be used to control the proportions of different types of pulp and filler material in the thick stock and to control the amounts of various additives (such as retention aid or dyes) that are mixed into the stock.

This represents a brief description of one type of paper machine 102 that may be used to produce a paper product. Additional details regarding this type of paper machine 102 are well-known in the art and are not needed for an understanding of this disclosure. Also, this represents one specific type of paper machine 102 that may be used in the system 100. Other machines or devices could be used that include any other or additional components for producing a paper product. In addition, this disclosure is not limited to use with systems for producing paper products and could be used with systems that process the produced paper or with systems that produce or process other items or materials, such as plastic, textiles, metal foil or sheets, or other or additional materials.

In order to control the paper-making process, one or more properties of the paper sheet 108 may be continuously or repeatedly measured. The sheet properties can be measured at one or various stages in the manufacturing process. This information may then be used to adjust the paper machine 102, such as by adjusting various actuators within the paper machine 102. This may help to compensate for any variations of the sheet properties from desired targets, which may help to ensure the quality of the sheet 108.

As shown in FIG. 1, the paper machine 102 includes two scanners 124-126, each of which may include one or more sensors. The scanners 124-126 are capable of scanning the paper sheet 108 and measuring one or more characteristics of the paper sheet 108. For example, the scanners 124-126 could include sensors for measuring the weight, moisture, caliper (thickness), gloss, color, smoothness, or any other or additional characteristics of the paper sheet 108.

As described in more detail below, one or more of the scanners 124-126 could include various mechanisms for stabilizing the paper sheet 108 relative to sensors in the scanners. For example, as the paper sheet 108 travels, a boundary layer of air could form on either or both sides of the sheet 108. Conventional scanner/sensor arrangements typically include block-like structures, which often create (i) turbulent overpressure and divergent air jets on the upstream side of the scanner/sensor arrangement and (ii) turbulent underpressure and convergent air jets on the downstream side of the scanner/sensor arrangement. This often leads to flutter or other unstable movement of the sheet 108 and reduces sheet tension in measurement areas. The reduced tension may exacerbate the flutter and allow curvature or aplanarity of the sheet path, such as the formation of standing and moving waves. As a result, this often causes dynamic positional perturbation of the sheet 108, meaning the position of the sheet 108 varies relative to a sensor. This often leads to bias, uncertainty, or other error in sensor measurements and may increase the likelihood of sheet breaks. As described below with respect to FIGS. 2 and 3, various mechanisms can be used with the scanners 124-126 to help stabilize the position of the sheet 108 relative to one or more sensors.

Each of the scanners 124-126 includes any suitable structure or structures for measuring or detecting one or more characteristics of the paper sheet 108, such as sets or arrays of sensors. A scanning or moving set of sensors represents one particular embodiment for measuring sheet properties. Other embodiments could be used, such as those using stationary sets or arrays of sensors.

The controller 104 receives measurement data from the scanners 124-126 and uses the data to control the paper machine 102. For example, the controller 104 may use the measurement data to adjust the various actuators in the paper machine 102 so that the paper sheet 108 has properties at or near desired properties. The controller 104 includes any hardware, software, firmware, or combination thereof for controlling the operation of at least part of the paper machine 102. In particular embodiments, the controller 104 may represent a proportional-integral-derivative (PID) controller or a cross-direction machine-direction (CDMD) model predictive controller (MPC).

The network 106 is coupled to the controller 104 and various components of the paper machine 102 (such as the actuators and the scanners 124-126). The network 106 facilitates communication between components of system 100. The network 106 represents any suitable network or combination of networks facilitating communication between components in the system 100. The network 106 could, for example, represent an Ethernet network, an electrical signal network (such as a HART or FOUNDATION FIELDBUS network), a pneumatic control signal network, or any Other or additional network(s).

Although FIG. 1 illustrates one example of a paper production system 100, various changes may be made to FIG. 1. For example, other systems could be used to produce paper products or other products. Also, while shown as including a single paper machine 102 with various components and a single controller 104, the production system 100 could include any number of paper machines or other production machinery having any suitable structure, and the system 100 could include any number of controllers. In addition, FIG. 1 illustrates one operational environment in which stabilization of a sheet material can be used. This functionality could be used in any other suitable system.

Figure 2:
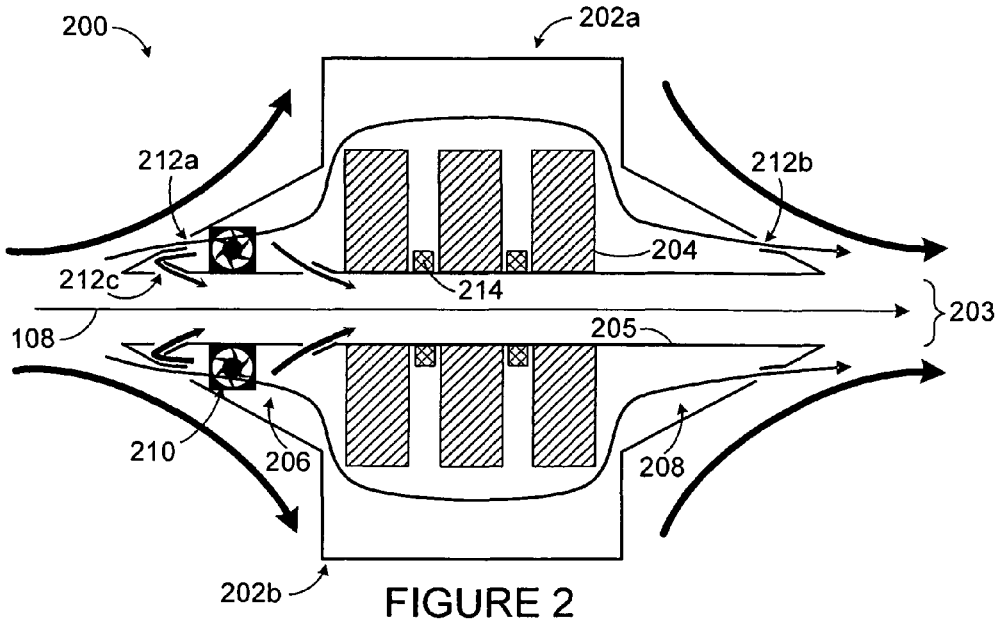
FIGS. 2 and 3 illustrate example mechanisms for stabilization of a moving sheet relative to a sensor according to one embodiment of this disclosure.
Figure 3:
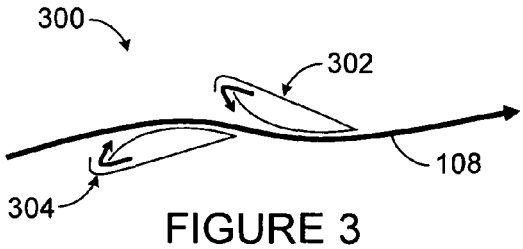

FIGS. 2 and 3 illustrate example mechanisms for stabilization of a moving sheet relative to a sensor according to one embodiment of this disclosure. More specifically, FIG. 2 illustrates an example sensor assembly or arrangement 200 for taking measurements of a sheet material while stabilizing the sheet material, and FIG. 3 illustrates an example air foil assembly or arrangement 300 for further stabilizing the sheet material. The embodiments shown in FIGS. 2 and 3 are for illustration only. Other embodiments of these mechanisms could be used without departing from the scope of this disclosure. Also, for ease of explanation, these mechanisms are described as forming at least part of the scanners 124-126 in the paper production system 100 of FIG. 1. These mechanisms could be used in any other or additional location in the system 100 or in any other manufacturing or processing system. These mechanisms could also be used to stabilize any suitable material and are not limited to use with a paper sheet 108.

As shown in FIG. 2, the sensor arrangement 200 includes two sensor carriages 202*a*-202*b* forming a gap 203 through which the sheet 108 travels. Each of the sensor carriages 202*a*-202*b* includes one or multiple sensors 204. The sensors 204 measure one or more characteristics of the sheet 108. For example, the sensors 204 could measure the weight, moisture, ash content, caliper (thickness), gloss, smoothness, color, brightness, opacity, porosity, or any other or additional characteristics of the sheet 108. Each sensor 204 includes any suitable structure for measuring one or more characteristics of a sheet of material, such as a photosensor, ionization chamber, spectrograph, camera, or mechanical sensor. A mechanical sensor could include a contacting or non-contacting caliper probe. In this example, each sensor 204 is located along an inner surface or wall 205 of a sensor carriage and directed perpendicular to the sheet 108. However, each sensor 204 could have any suitable arrangement and position relative to the sheet 108.

In this example, each of the sensor carriages 202*a*-202*b* also includes angled portions 206-208. Each angled portion 206 is angled in the direction of travel of the sheet 108 and is located on the upstream side of the sensor arrangement 200. Each angled portion 208 is angled in the sheet's direction of travel and is located on the downstream side of the sensor arrangement 200. The shape of the angled portions 206-208 in particular and the shape of the sensor carriages 202*a*-202*b* in general could be altered in any suitable manner. For example, the wedge shape of the angled portions 206-208 could be more or less wedge-like, and other more aerodynamic shapes (such as teardrop or battleship shapes) could be used for the sensor carriages 202*a*-202*b*.

Each of the sensor carriages 202*a*-202*b* in this example further includes at least one fan 210 and multiple slots 212*a*-212*c*. The fans 210 operate to move air into, within, or out of the sensor carriages 202*a*-202*b*, and the slots 212*a*-212*c* provide inlets and outlets for air to enter and leave the sensor carriages 202*a*-202*b*. The fans 210 represent any suitable structures for actively moving air into, within, or out of the sensor carriages 202*a*-202*b*. One or multiple fans 210 could be used in each sensor carriage and be placed in any suitable location(s) in the sensor carriage. The slots 212*a*-212*c* represent any suitable inlets or outlets for air. The slots 212*a*-212*c* could have any suitable size or shape and be placed in any suitable location(s) in the sensor carriages 202*a*-202*b*. In particular embodiments, the slots 212*a*-212*b* may span the entire width of the sensor carriages 202*a*-202*b*, while the slots 212*c* may represent smaller slots located near individual sensors 204.

In one aspect of operation, the sensors 204 in the sensor arrangement 200 measure at least one property of the sheet 108. Each sensor 204 may take its measurements at a particular measurement location as the sheet 108 moves past that measurement location. Depending on the implementation, the sensor arrangement 200 may move, and the corresponding measurement locations for the sensors 204 may also move. In particular embodiments, the sensor arrangement 200 traverses the sheet 108 approximately perpendicular to the movement of the sheet 108. Also, the sheet movement may be in a plane generally parallel to measuring faces of the sensors 204. In addition, the sheet 108 could move between generally parallel measuring faces of sensors 204 on opposing sides of the sheet 108 or parallel to a single sensor plate in which the sensors 204 are mounted.

To help stabilize the position of the sheet 108, the sensor carriages 202*a*-202*b* include the angled portions 206-208. The angled portions 206 of the sensor carriages 202*a*-202*b* help to deflect upstream boundary layers of air above and below the sheet 108. This deflection is typically less turbulent than the deflection that occurs in conventional sensor arrangements. Conventional sensor arrangements typically have sides that are essentially perpendicular to the direction of a sheet's travel, meaning the upstream boundary layers of air impact perpendicular walls both above and below the sheet. By using the angled portions 206 in the sensor carriages 202*a*-202*b*, the upstream boundary layers of air above and below the sheet 108 are deflected in a way that causes less perturbation to the sheet's position. Similarly, the angled portions 208 of the sensor carriages 202*a*-202*b* allow for less turbulent reformations of the downstream boundary layers above and below the sheet 108.

The fans 210 and the slots 212*a*-212*c* can also help to stabilize the position of the sheet 108. As shown in FIG. 2, the slots 212*a* are used to draw air from the upstream boundary layers into the sensor carriages 202*a*-202*b*. The slots 212*b* are used to allow air to exit the sensor carriages 202*a*-202*b* into the downstream boundary layers. The slots 212*c* are used to allow air to exit the sensor carriages 202*a*-202*b* into the gap 203 between the sensor carriages 202*a*-202*b*. The fans 210 in this example can be used to move air within the sensor carriages 202*a*-202*b* and out of at least some of the slots 212*b*-212*c*.

The air flows provided out of the slots 212*c* into the gap 203 between the sensor carriages 202*a*-202*b* can be used to stabilize the position of the sheet 108 in the gap 203 and to control the relative distance of the sheet 108 from each sensor carriage. The air flows through the slots 212*c* help to stabilize the sheet 108 by manipulating boundary layers of air between the sheet 108 and the sensor carriages 202*a*-202*b* within the gap 203. Due to, for example, the Coanda effect and the Bernoulli principle, the air flows from the slots 212*c* of one sensor carriage form or influence a boundary layer between the sheet 108 and the wall 205 of that sensor carriage. This boundary layer may have a lower pressure than the air on the other side of the sheet 108, which draws the sheet 108 towards the wall 205 of that sensor carriage. By controlling the air flows from the slots 212*c* on both sides of the sheet 108, the relative position of the sheet 108 in the gap 203 between the sensor carriages 202*a*-202*b* can be controlled. The flow rate of the air flows from the slots 212*c* may determine the pressure and other characteristics of the boundary layers in the gap 203 and therefore constrain the sheet 108 to a narrow range of distances from each sensor carriage. This may keep the position and angle of the sheet 108 generally constant at the sensors' measurement locations.

The air flows from the slots 212*c* may also exert frictional forces on the sheet 108 that may alter the sheet's tension. By providing multiple air flows, some of which may be directed at least partly away from the location where a measurement is performed, a suitable tension can be formed in the sheet 108 at that measurement location. With sufficient local tension, the sheet 108 may be constrained to be nearly planar at the measurement location.

In some embodiments, the position and angle of the sheet 108 is stabilized by providing air flows from the slots 212*c* that are generally tangential to the wall 205 of the sensor carriage, which may be parallel to the sheet's direction of travel. Each slot 212*c* could be located near or adjacent to the location in which a sensor 204 measures a property of the sheet 108, and the direction of air flow may be generally the same as the sheet's direction of movement. The slots 212*c* could be positioned on one or both sides of each sensor 204 or group of sensors 204.

In other embodiments, the position and angle of the sheet 108 is stabilized by providing air flows from the slots 212*c* in multiple directions. At least two of the air flows could have directions with significant transverse components, where each transverse component is in a direction away from a measurement location and the sum of the transverse components is approximately zero. Also, at least one of the air flows could have a significant flow component in the direction of the sheet's movement, where the sum of the air flows is a net flow in the direction of sheet movement.

In yet other embodiments, tangential air flows are provided on a first side of the sheet 108. At least one additional tangential air flow is provided on the second side of the sheet 108 in order to control the pressure fluctuations on the second side of the sheet 108 in the gap 203. This may help to enhance the stabilization achieved by the air flows on the first side of the sheet 108. These additional air flows may have a lower speed than the flows on the first side of the sheet 108.

In particular embodiments, it is possible to provide a mechanism for measuring the sheet position at one or more locations. For example, one or more of the sensor carriages 202*a*-202*b* could include at least one position sensor 214, which could use any suitable technique to identify a distance or location of the sheet 108. Suitable techniques for measuring the position could include triangulation using a projected optical pattern and an image detector, which allows the sheet position and aplanarity to be measured. In these embodiments, the position of the sheet 108 can be actively controlled by regulating the air flow rate through at least one slot 212*c*. Similarly, the angle of the sheet 108 could be measured or inferred from measurements of the sheet's position at multiple locations. In this case, the sheet angle can be actively controlled by regulating the air flow rate through at least one slot 212*c*. In addition, sheet aplanarity can be measured or inferred from measurements of the sheet's position at a sufficient number of locations. Again, the sheet planarity or aplanarity can be controlled by regulating the air flow rate through at least one slot 212*c*.

The sensor carriages 202*a*-202*b* may each include multiple sensors 204, such as sensors 204 arranged such that their measurement locations are separated by distances of 10 cm or more. In these sensor carriages 202*a*-202*b*, the slots 212*c* could be used to stabilize the sheet 108 independently for more than one measurement location. In particular embodiments, to provide a greater degree of stabilization, all proximal slots 212*c* could stabilize the sheet 108 in generally the same plane.

Another cause of sheet instability is the upstream and downstream boundary layers formed before and after the sensor carriages 202*a*-202*b*. These turbulent air jets may be created due to deflection of the boundary flows accompanying a moving sheet 108 as it approaches the sensor arrangement 200 and reformation of the boundary flows after the sheet 108 leaves the sensor arrangement 200. Their effect is to make the ingress and egress sheet positions unstable at the boundaries of the sensor arrangement 200. The air jets may also reduce sheet tension so that flutter effects are worsened. Turbulent overpressure, underpressure, and air flows around the sensor carriages 202*a*-202*b* can be reduced using suitable streamlined shapes in the sensor carriages 202*a*-202*b*, such as the angled portions 206-208 of the sensor carriages 202*a*-202*b* as described above.

The slots 212*a*-212*b* may also help to reduce or eliminate the effects of these upstream and downstream boundary layers on the sheet 108 and to stabilize the sheet 108. In these embodiments, each sensor carriage 202*a*-202*b* could be viewed as including two chambers, one on the left side and one on the right side of each sensor carriage in FIG. 2. In the example shown in FIG. 2, the slots 212*a* lead into one chamber, and the slots 212*b* lead out of the other chamber. Here, each chamber on the left may be kept at a lowered pressure for drawing air from an upstream boundary layer, and each chamber on the right may be kept at a raised pressure for blowing air onto the sheet 108 to at least partially form a downstream boundary layer. The fans 210 are used to maintain this pressure differential between the chambers of the sensor carriages 202*a*-202*b*. The air flows from the slots 212*b* could be directed generally tangentially onto the sheet 108.

In this way, the air used for reforming the downstream boundary layers at least partly represents the air removed from the upstream boundary layers. By actively removing air at the entrance to the sensor arrangement 200, turbulent overpressure is reduced upstream of the sensor carriages 202*a*-

202*b*. Similarly, by actively restoring air at the exit of the sensor arrangement 200, turbulent underpressure is reduced downstream of the sensor carriages 202*a*-202*b*. This technique can be used instead of or in addition to the streamlining of the sensor carriages 202*a*-202*b*. When used together, streamlining can reduce the amount of air that must be removed from and/or restored to the boundary layers in order to obtain a given amount of stabilization.

While these embodiments have described the use of slots 212*a*-212*c*, other structures could be used in the sensor carriages 202*a*-202*b*. For example, in other embodiments, one, some, or all of the slots 212*b*-212*c* could be replaced by nozzles or vorticles, such as elongated and generally linear slot nozzles (with the long axis of the slots being generally perpendicular to the direction of movement of the sheet 108). Non-elongated nozzles could also be used to produce air flows, such as air flows directed generally in the same direction as the movement of the sheet 108. Also, the air flows provided through the slots 212*b*-212*c* need not be based on air received through the slots 212*a*. In other embodiments, compressed air or air from other sources could be provided through the slots 212*b*-212*c*. In addition, depending on the implementation, not all of the slots 212*a*-212*c* shown in FIG. 2 may be used.

As shown in FIG. 3, the air foil arrangement 300 includes two air foils 302-304 for stabilizing the sheet 108. The air foils 302-304 could be used to stabilize the sheet 108 before and/or after sensor measurements are taken of the sheet 108. The air foils 302-304 could, for example, be used prior to or after the sensor arrangement 200 shown in FIG. 2. If positioned upstream of the sensors 204, the air foils 302-304 may deflect the sheet 108 from any of a range of approach angles and planes generally towards the sensor gap 203 between the sensor carriages 202*a*-202*b*. If positioned downstream of the sensors 204, the air foils 302-304 may deflect the sheet 108 in any suitable direction and help to maintain the tension of the sheet 108 within the sensor arrangement 200. The air foils 302-304 could extend generally across the entire width of the sensor gap 203. In a variation of this embodiment, the air foils could extend substantially across the whole width of the moving sheet.

Although shown as including two air foils 302-304, a single air foil could be used before and/or after the measurement sensors. For example, two air foils could be placed in sequential proximity (as shown in FIG. 3) to increase the stability of the moving sheet 108 entering the sensor gap 203. A single downstream air foil may be positioned so that the sheet plane is stabilized on egress from the sensor gap 203 so that the sheet's position is not dynamically deflected by turbulence.

In this example embodiment, the air foils 302-304 represent active air foils. An active air foil may include at least one air discharge slot, nozzle, or other structure on the curved surface that guides the sheet 108. The slot, nozzle, or other structure provides an air flow, which may help to confine the sheet path with greater accuracy and without causing tension disturbances through frictional or shear forces. In other embodiments, passive air foils could be used.

Although FIGS. 2 and 3 illustrate examples of mechanisms for stabilization of a moving sheet 108 relative to a sensor, various changes may be made to FIGS. 2 and 3. For example, any number of sensor carriages 202*a*-202*b* could be used (including a single sensor carriage). Also, each sensor carriage could include any number of sensors 204 in any suitable arrangement, and each sensor carriage may or may not include one or more position sensors 214. Further, while shown as including slots 212*a*-212*c*, each sensor carriage could include a subset of these slots or any other or additional slots, and the arrangement and positioning of the slots 212*a*-212*c* is for illustration only. Beyond that, the overall shape of each sensor carriage is for illustration only, and each sensor carriage could have any other shape or shapes (whether or not the shapes match). In addition, the sensor arrangement 200 and the air foil arrangement 300 could be used independently of one another.

Figure 4:
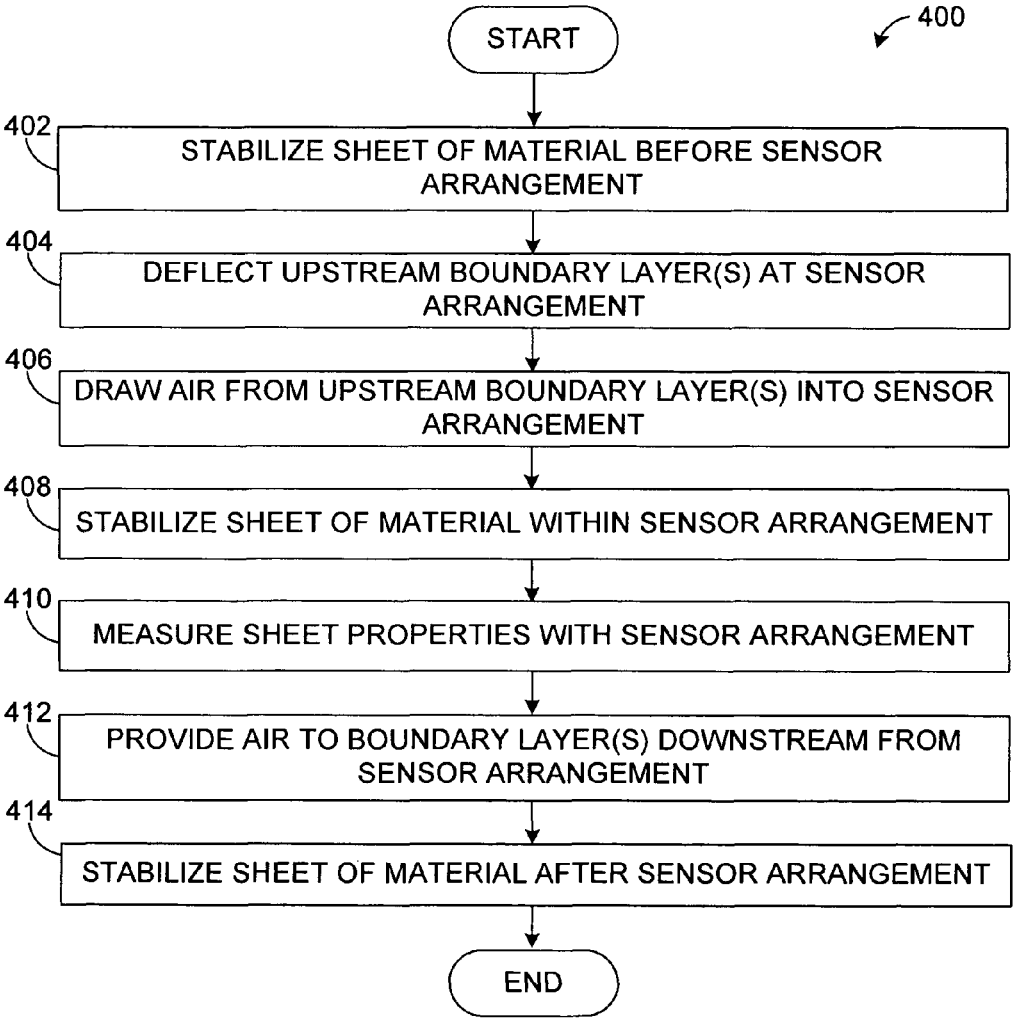
FIG. 4 illustrates an example method for stabilization of a moving sheet relative to a sensor according to one embodiment of this disclosure.

FIG. 4 illustrates an example method 400 for stabilization of a moving sheet relative to a sensor according to one embodiment of this disclosure. The embodiment of the method 400 shown in FIG. 4 is for illustration only. Other embodiments of the method 400 could be used without departing from the scope of this disclosure. Also, for ease of explanation, the method 400 in FIG. 4 is described as being performed by the sensor arrangement 200 of FIG. 2 and the air foil arrangement 300 of FIG. 3 in the system 100 of FIG. 1. The method 400 could be used with any other suitable devices and in any other suitable system.

A sheet 108 is stabilized before reaching a sensor arrangement at step 402. This may include, for example, using one or more air foils 302-304 to stabilize the sheet 108 before reaching the sensor arrangement 200. This may also include using the air foils 302-304 to deflect the sheet 108 from an approach angle and plane generally towards the sensor gap 203 of the sensor arrangement 200.

One or more upstream boundary layers of air are at least partially deflected at the sensor arrangement at step 404. This may include, for example, the angled portions 206 of the sensor carriages 202*a*-202*b* deflecting the upstream boundary layers above and below the sheet 108.

Part of the air from one or more of the upstream boundary layers is drawn into the sensor arrangement at step 406. This may include, for example, the fans 210 in the sensor carriages 202*a*-202*b* drawing at least some of the air from the upstream boundary layers into the sensor carriages 202*a*-202*b*. The fans 210 could actively pull the air into the sensor carriages 202*a*-202*b*. The fans 210 could also generate a lower pressure in part of the sensor carriages 202*a*-202*b*, which causes some of the air from the upstream boundary layers to be pulled into the sensor carriages 202*a*-202*b*.

The sheet 108 is stabilized within the sensor arrangement at step 408. This may include, for example, providing air flows from the slots 212*c* of the sensor carriages 202*a*-202*b*. These air flows may help to stabilize the sheet 108 by drawing the sheet 108 into a specified or desired position between the sensor carriages 202*a*-202*b*. The air flows could all be tangential to the sheet's direction of travel, or one or more of the air flows could be directed at least partly away from the location where a measurement is to be performed (allowing the tension of the sheet 108 in that location to be controlled). One or more position sensors 214 can be used during this step to ensure that the sheet 108 has a desired position (where multiple positions can be controlled to control the angle or planarity of the sheet 108). If necessary, the air flows from the slots 212*c* of one or more sensor carriages 202*a*-202*b* can be adjusted to change the position of the sheet 108. As an example, the sheet 108 could be moved closer to one sensor carriage by increasing the tangential air flows from that sensor carriage.

One or more properties of the sheet 108 are measured at step 410. This could include, for example, the sensors 204 taking measurements of the sheet 108.

Air from within the sensor arrangement is provided to one or more downstream boundary layers at step 412. This may include, for example, the fans 210 in the sensor carriages 202*a*-202*b* forcing at least some of the air from the sensor arrangement 200 out of the sensor arrangement 200 through the slots 212*b*. For example, fans 210 could be positioned near the slots 212*b* to force the air out of the sensor arrangement 200, or fans 210 near the slots 212*a* could push air towards the slots 212*b* on the opposite side of the sensor carriages 202*a*-202*b*.

The sheet 108 is stabilized after leaving the sensor arrangement at step 414. This may include, for example, using one or more air foils 302-304 to stabilize the sheet 108 after the sheet 108 exits the sensor arrangement 200.

Although FIG. 4 illustrates one example of a method 400 for stabilization of a moving sheet 108 relative to a sensor, various changes may be made to FIG. 4. For example, not all of the steps may be performed to stabilize a sheet 108. For example, steps 402 and 412 could be omitted, such as when no air foils are used with the sensor arrangement 200. As another example, step 404 could be omitted, such as when the sensor carriages 202*a*-202*b* have no angled portions 206. These examples are for illustration only. Various techniques have been described here for stabilizing the sheet 108, and these techniques may be used individually or in any suitable combination.

It may be advantageous to set forth definitions of certain words and phrases used throughout this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. The term "controller" means any device, system, or part thereof that controls at least one operation. A controller may be implemented in hardware, firmware, software, or some combination of at least two of the same. The functionality associated with any particular controller may be centralized or distributed, whether locally or remotely.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An apparatus, comprising:

a sensor operable to measure a property of a sheet of material; and a sensor carriage operable to carry the sensor, the sensor carriage also operable to generate an air flow that is substantially tangential to the sheet in order to at least partially control a position of the sheet relative to the sensor carriage, wherein the sensor carriage comprises:

a first slot in a first surface of the sensor carriage, the first slot configured to receive at least a portion of air from a first boundary layer of air associated with the sheet that is upstream from the sensor carriage;

a second slot in a second surface of the sensor carriage, the second slot configured to provide at least a portion of air in a second boundary layer of air associated with the sheet that is downstream from the sensor carriage, the second surface on an opposite side of the sensor carriage than the first surface; and a third slot in a third surface of the sensor carriage, the third slot configured to provide the air flow that is substantially tangential to the sheet wherein at least the first and second slots are fluidly coupled to a chamber within the sensor carriage, the chamber adjacent to an area of travel of the sheet.

2. The apparatus of claim 1, wherein the sensor carriage comprises multiple third slots configured to generate multiple substantially tangential air flows.

3. The apparatus of claim 1, further comprising:

a fan operable to lower a pressure in a first portion of the sensor carriage and to raise a pressure in a second portion of the sensor carriage, the first slot associated with the first portion of the sensor carriage, the second slot associated with the second portion of the sensor carriage.

4. The apparatus of claim 3, wherein:

one third slot is located on one side of the fan; and another third slot is located on another side of the fan.

5. The apparatus of claim 1, wherein:

the apparatus includes two sensor carriages; and each sensor carriage is operable to provide an air flow that is substantially tangential to the sheet.

6. The apparatus of claim 1, wherein the sensor carriage includes an angled portion that is angled at a degree greater than zero with respect to a direction of travel of the sheet, the angled portion configured to deflect one of the boundary layers, the angled portion including one of the first and second slots.

7. A system, comprising:

a sheet machine operable to at least one of: manufacture and process a sheet of material; and a sensor assembly including a sensor operable to measure a property of the sheet, the sensor assembly operable to generate an air flow that is substantially tangential to the sheet in order to at least partially control a position of the sheet relative to the sensor assembly, wherein the sensor assembly further includes a sensor carriage comprising:

a first slot in a first surface of the sensor carriage, the first slot configured to receive at least a portion of air from a first boundary layer of air associated with the sheet that is upstream from the sensor carriage;

a second slot in a second surface of the sensor carriage, the second slot configured to provide at least a portion of air in a second boundary layer of air associated with the sheet that is downstream from the sensor carriage, the second surface on an opposite side of the sensor carriage than the first surface, the second slot operable to provide at least a portion of the air in the downstream boundary layer; and a third slot in a third surface of the sensor carriage, the third slot configured to provide the air flow that is substantially tangential to the sheet wherein at least the first and second slots are fluidly coupled to a chamber within the sensor carriage, the chamber adjacent to an area of travel of the sheet.

8. The system of claim 7, wherein the sensor assembly further comprises:

a fan operable to lower a pressure in a first portion of the sensor carriage and to raise a pressure in a second portion of the sensor carriage, the first slot associated with the first portion of the sensor carriage, the second slot associated with the second portion of the sensor carriage.

9. The system of claim 7, further comprising one or more air foils operable to at least one of: stabilize the sheet prior to reaching the sensor assembly and stabilize the sheet after leaving the sensor assembly.

10. The system of claim 9, wherein:

at least one of the air foils includes a curved surface; and a second air flow is provided over the curved surface.

11. The system of claim 9, wherein at least one of the air foils extends substantially across a width of the sheet.

12. The system of claim 7, wherein the sensor carriage comprises multiple third slots configured to generate multiple substantially tangential air flows.

13. The system of claim 7, wherein the sensor assembly is configured to traverse the sheet approximately perpendicular to a direction of movement of the sheet.

14. The system of claim 7, wherein the sensor carriage includes an angled portion that is angled at a degree greater than zero with respect to a direction of travel of the sheet, the angled portion configured to deflect one of the boundary layers, the angled portion including one of the first and second slots.

15. The system of claim 7, wherein at least one of the first and second slots spans a width of the sensor assembly.

16. A sensor carriage comprising:

a first slot in a first surface of the sensor carriage, the first slot configured to receive at least a portion of air from a first boundary layer of air associated with a sheet of material that is upstream from the sensor carriage, the first slot operable to receive at least a portion of the air from the first boundary layer;

a second slot in a second surface of the sensor carriage, the second slot configured to provide at least a portion of air in a second boundary layer of air associated with the sheet that is downstream from the sensor carriage, the second surface on an opposite side of the sensor carriage than the first surface; and a third slot in a third surface of the sensor carriage, the third slot operable to provide an air flow that is substantially tangential to the sheet in order to at least partially control a position of the sheet relative to the sensor carriage wherein at least the first and second slots are fluidly coupled to a chamber within the sensor carriage, the chamber adjacent to an area of travel of the sheet.

17. The sensor carriage of claim 16, further comprising:

a sensor operable to measure a property of the sheet.

18. The sensor carriage of claim 16, wherein the sensor carriage comprises multiple third slots configured to generate multiple substantially tangential air flows.

19. The sensor carriage of claim 16, further comprising:

a fan operable to lower a pressure in a first portion of the sensor carriage and to raise a pressure in a second portion of the sensor carriage, the first slot associated with the first portion of the sensor carriage, the second slot associated with the second portion of the sensor carriage.

* * * * *